US012264463B2

(12) United States Patent
Harrison

(10) Patent No.: US 12,264,463 B2
(45) Date of Patent: Apr. 1, 2025

(54) TOILET FIXTURE CLOG PREVENTION AND CLEANOUT

(71) Applicant: SDB IP Holdings, LLC, Oviedo, FL (US)

(72) Inventor: Christopher Harrison, Deltona, FL (US)

(73) Assignee: SDB IP Holdings, LLC, Oviedo, FL (US)

( * ) Notice: Subject to any disclaimer, the term of this patent is extended or adjusted under 35 U.S.C. 154(b) by 0 days.

(21) Appl. No.: 18/322,215

(22) Filed: May 23, 2023

(65) Prior Publication Data

US 2023/0295912 A1 Sep. 21, 2023

Related U.S. Application Data

(62) Division of application No. 17/067,214, filed on Oct. 9, 2020, now Pat. No. 11,692,338.

(60) Provisional application No. 62/913,233, filed on Oct. 10, 2019.

(51) Int. Cl.

| | |
|---|---|
| ***E03C 1/00*** | (2006.01) |
| ***E03C 1/282*** | (2006.01) |
| ***E03D 11/13*** | (2006.01) |
| *E03D 11/18* | (2006.01) |

(52) U.S. Cl.

CPC ..... *E03C 1/00* (2013.01); *E03C 1/282* (2013.01); *E03D 11/13* (2013.01); *E03D 11/18* (2013.01)

(58) Field of Classification Search

CPC .. B01D 29/114–115; B01D 35/005–02; E03B 7/07; E03C 1/10; E03C 1/264; E03C 1/282; E03D 1/38; E03D 5/003–006; E03D 5/016; E03D 9/00; E03D 9/031; E03D 9/06; Y10S 4/14; Y10T 137/8085–8122

See application file for complete search history.

(56) References Cited

U.S. PATENT DOCUMENTS

| | | | | |
|---|---|---|---|---|
| 957,709 | A * | 5/1910 | Phillips | E03D 9/031 137/544 |
| 1,755,040 | A | 4/1930 | Wallace | |
| 1,817,376 | A | 8/1931 | Izquierdo | |
| 1,928,717 | A | 10/1933 | Campus | |

(Continued)

FOREIGN PATENT DOCUMENTS

| | | | |
|---|---|---|---|
| CN | 109610589 | A | 4/2019 |
| EP | 0298335 | A1 | 1/1989 |

(Continued)

*Primary Examiner* — David P Angwin
*Assistant Examiner* — Nicholas A Ros
(74) *Attorney, Agent, or Firm* — The Webb Law Firm

(57) ABSTRACT

A toilet fixture is provided including an inlet pipe, a toilet bowl in fluid communication with the inlet pipe, an outlet pipe in fluid communication with the toilet bowl, a jet pipe in fluid communication with the inlet pipe and the outlet pipe, and a removable jet pipe assembly that connects the jet pipe to the outlet pipe. A foreign object strainer may be positioned in-line with the inlet pipe. A flush assembly may also include a flush valve, a vacuum breaker tube in fluid communication with the flush valve, a foreign object strainer in fluid communication with the vacuum breaker tube, and an outlet pipe in fluid communication with the foreign object strainer.

5 Claims, 10 Drawing Sheets

(56) References Cited

U.S. PATENT DOCUMENTS

| | | | | | |
|---|---|---|---|---|---|
| 1,998,861 | A | | 4/1935 | Campus | |
| 3,224,013 | A | | 12/1965 | Tubbs | |
| 3,654,641 | A | | 4/1972 | Braun, Sr. | |
| 4,164,048 | A | * | 8/1979 | Kampfer | E03C 1/282 4/DIG. 14 |
| 4,250,037 | A | * | 2/1981 | Kempa | E03C 1/282 210/310 |
| 5,067,181 | A | * | 11/1991 | Hafner | E03D 11/08 4/430 |
| 5,388,610 | A | * | 2/1995 | Chuang | E03D 3/02 251/40 |
| 5,502,845 | A | | 4/1996 | Hayashi et al. | |
| 5,525,215 | A | * | 6/1996 | Marchionda | B01D 29/117 210/162 |
| 5,944,991 | A | * | 8/1999 | Shellenbarger | F16L 55/24 210/489 |
| 6,308,350 | B1 | * | 10/2001 | Marchionda | E03C 1/282 4/679 |
| 6,494,325 | B1 | * | 12/2002 | Mizrahi | B01D 35/02 4/290 |
| 6,662,381 | B1 | | 12/2003 | Powell et al. | |
| 6,675,399 | B1 | | 1/2004 | Tomita et al. | |
| 6,802,424 | B2 | * | 10/2004 | Ouyoung | E03C 1/0408 137/550 |
| 6,928,666 | B1 | | 8/2005 | Schaffer | |
| 7,461,410 | B1 | | 12/2008 | Shaffer | |
| 8,418,277 | B2 | | 4/2013 | Okubo et al. | |
| 9,945,111 | B1 | | 4/2018 | Nuncio | |
| 10,352,028 | B2 | * | 7/2019 | Boeltl | E03D 11/11 |
| 2008/0244819 | A1 | | 10/2008 | Meador | |
| 2017/0130437 | A1 | | 5/2017 | Grover et al. | |

FOREIGN PATENT DOCUMENTS

| | | | |
|---|---|---|---|
| JP | S51127335 | U | 10/1976 |
| JP | H1171802 | A | 3/1999 |
| JP | 2012036622 | A | 2/2012 |
| KR | 100760108 | B1 | 9/2007 |
| KR | 1020130024226 | A | 3/2013 |

* cited by examiner

TOILET FIXTURE CLOG PREVENTION AND CLEANOUT

CROSS-REFERENCE TO RELATED APPLICATIONS

This application is a division of U.S. patent application Ser. No. 17/067,214 filed on Oct. 9, 2020, which claims to the benefit of U.S. Provisional Patent Application No. 62/913,233 filed on Oct. 10, 2019, the contents of which are hereby fully incorporated by reference.

BACKGROUND OF THE INVENTION

Field of the Invention

The present disclosure, in general, relates to a toilet fixture and, more particularly, to a toilet fixture having a clog prevention and cleanout arrangement.

Description of Related Art

In current toilet fixtures, angle stop sealing material, flush valve diaphragms, and vacuum breaker rubber have a tendency to deteriorate over time causing these elements to break apart and flow into the piping system of a toilet fixture. This deterioration and general debris in piping systems cause blockages downstream of the water closet's inlet in the blowout jet or flush rim holes that rinse the bowl of the toilet fixture. These blockages result in poor flushing and removal of waste from the toilet bowl. It is particularly difficult to remove this debris in a blowout jet when the blowout jet is welded into a waste pipe and requires the toilet fixture to be removed from the wall and sent back to the manufacturer, where the toilet fixture is cut apart, re-welded and then sent back to the customer for reinstallation. Others have also tried removing the toilet fixture from the wall, turning the toilet fixture over, and heating the blowout jet area with a torch in an attempt to melt the debris while hammering on the blowout jet area to release the melted debris.

SUMMARY OF THE INVENTION

In view of the foregoing, there is a current need for a toilet fixture that includes a clog prevention and cleanout assembly. There is a further need for a toilet fixture that can stop debris from entering the toilet bowl. There is a further need for a toilet fixture that allows for easy and improved cleanout of debris from the toilet fixture in the event debris enters the toilet bowl.

In one example of the present disclosure, a toilet fixture may include an inlet pipe, a toilet bowl in fluid communication with the inlet pipe, an outlet pipe in fluid communication with the toilet bowl, a jet pipe in fluid communication with the inlet pipe and the outlet pipe, and a removable jet pipe assembly that connects the jet pipe to the outlet pipe.

In another example of the present disclosure, the removable jet pipe assembly may include a mounting base positioned on the outlet pipe, and a jet removably connected to the mounting base. The removable jet pipe assembly may include a locking mechanism for removal of the jet from the mounting base and attached of the jet to the mounting base. The locking mechanism may include a pair of locking arms that hold the jet to the mounting base. At least one of the locking arms may be spring-biased to permit the locking arm to move relative to the mounting base between a locked position and an unlocked position. The locking mechanism may include at least one screw member for adjusting a biasing force of the spring-biased locking arm. A fitting may be provided in-line with the inlet pipe, wherein the fitting is connected to the jet pipe. The fitting may include a cleanout hole that permits access to an interior space of the inlet pipe and jet pipe.

In another example of the present disclosure, a toilet fixture may include an inlet pipe, a toilet bowl in fluid communication with the inlet pipe, an outlet pipe in fluid communication with the toilet bowl, a jet pipe in fluid communication with the inlet pipe and the outlet pipe, and a foreign object strainer positioned in-line with the inlet pipe.

In another example of the present disclosure, the foreign object strainer includes a main body, a foreign object strainer plate positioned within the main body, and a foreign object reservoir positioned beneath the foreign object strainer plate. The foreign object strainer may include a removable cover, wherein the removable cover supports the foreign object reservoir in the foreign object strainer. The removable cover may be threadedly attached to the main body. The foreign object strainer plate may define at least one aperture. The at least one aperture may be sized so permit fluid to pass therethrough and block debris in the fluid from passing therethrough. The foreign object strainer plate may be positioned at an angle relative to the main body.

In another example of the present disclosure, a flush assembly may include a flush valve, a vacuum breaker tube in fluid communication with the flush valve, a foreign object strainer in fluid communication with the vacuum breaker tube, and an outlet pipe in fluid communication with the foreign object strainer.

In another example of the present disclosure, the foreign object strainer may include a main body, a foreign object strainer plate positioned within the main body, and a foreign object reservoir positioned beneath the foreign object strainer plate. The foreign object strainer may include a removable cover, wherein the removable cover supports the foreign object reservoir in the foreign object strainer. The foreign object strainer plate may be positioned at an angle relative to the main body. The foreign object strainer plate may define at least one aperture. The at least one aperture may be sized so permit fluid to pass therethrough and block debris in the fluid from passing therethrough.

In another example of the present disclosure, a toilet fixture may include a jet pipe adapted to be placed in fluid communication with an inlet pipe and an outlet pipe, wherein the inlet pipe and outlet pipe are in fluid communication with a toilet bowl; and a removable jet pipe assembly configured to selectively connect and disconnect the jet pipe to the outlet pipe. The removable jet pipe assembly may include a mounting base adapted to be positioned on the outlet pipe; and a jet removably connected to the mounting base.

Further details and advantages will be understood from the following detailed description read in conjunction with the accompanying drawings.

DESCRIPTION OF THE DISCLOSURE

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings, figures, or otherwise described herein are simply exemplary and should not be considered as limiting.

The present disclosure is directed to, in general, a toilet fixture and, in particular, to a toilet fixture with a clog prevention and cleanout arrangement. Certain preferred and non-limiting examples of the components of the toilet fixture are illustrated in FIGS. 1-14.

Figure 1:
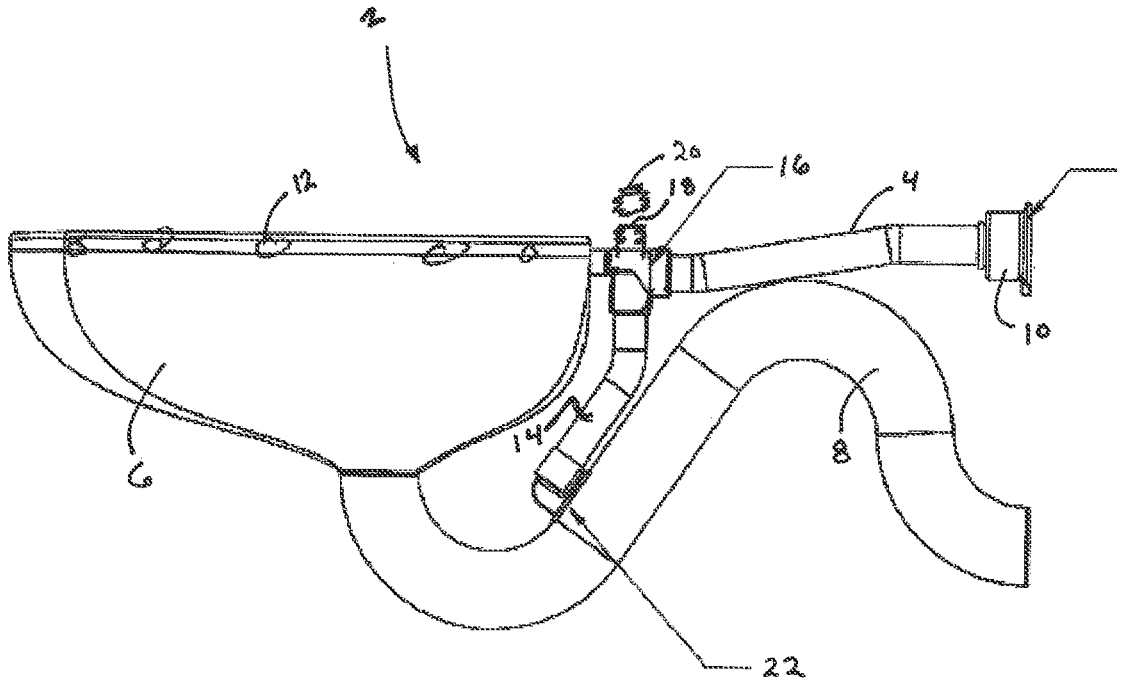
FIG. 1 is a side view of a toilet fixture according to one example of the present disclosure.
Figure 2:
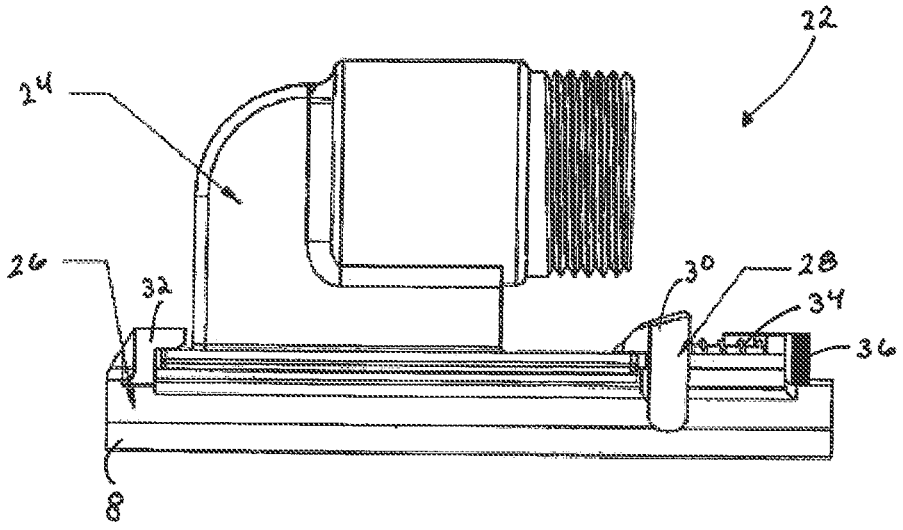
FIG. 2 is a side view of a jet assembly of the toilet fixture of FIG. 1 according to one example of the present disclosure.
Figure 3:
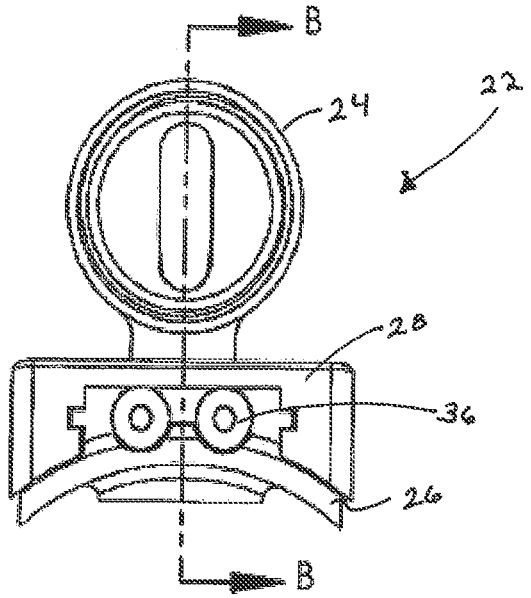
FIG. 3 is a rear view of the jet assembly of FIG. 2.

With reference to FIG. 1, a toilet fixture 2 utilizing a clog prevention and cleanout arrangement is shown and described. The toilet fixture 2 includes an inlet pipe 4, a toilet bowl 6 and an outlet/waste pipe 8. The inlet pipe 4 may include a fitting ring 10 for connection to a flush assembly (not shown in FIG. 1) that is positioned behind a wall upon which the toilet fixture 2 is anchored. Fluid from the flush assembly is directed to the inlet pipe 4 and into the toilet bowl 6. The toilet bowl 6 may be any type of toilet bowl generally known in the art. The toilet bowl 6 may include a plurality of flush rim rinse holes 12 defined in an upper edge of the toilet bowl 6. Waste and fluid from the toilet bowl 6 are flushed out of the toilet fixture 2 through the outlet pipe 8. The inlet pipe 4, the toilet bowl 6, and the waste pipe 8 may be made of stainless steel and may be pre-welded together before installation of the toilet fixture 2 on the wall.

As discussed above, debris from the flush assembly may be directed to the toilet fixture 2 via the inlet pipe 4. This debris may be directed into the toilet bowl 6, which can cause clogging of the toilet bowl 6, and/or may be directed through a jet pipe 14 that fluidly connects the inlet pipe 4 to the outlet pipe 8. The jet pipe 14 may also direct fluid from the inlet pipe 4 to the outlet pipe 8 to assist in flushing any waste or debris from the outlet pipe 8. The debris from the flush assembly, however, may begin to also clog in the outlet pipe 8. Therefore, in this example of the toilet fixture 2, a fitting 16 is positioned in-line with the inlet pipe 4 and is connected to the jet pipe 14. The fitting 16 includes a cleanout hole 18 that permits an individual to access the interior of the inlet pipe 4 and/or the jet pipe 14 to remove any debris that has been directed therethrough from the flush assembly. The fitting 16 may include a removable cap 20 to cover the cleanout hole 18.

Figure 4:
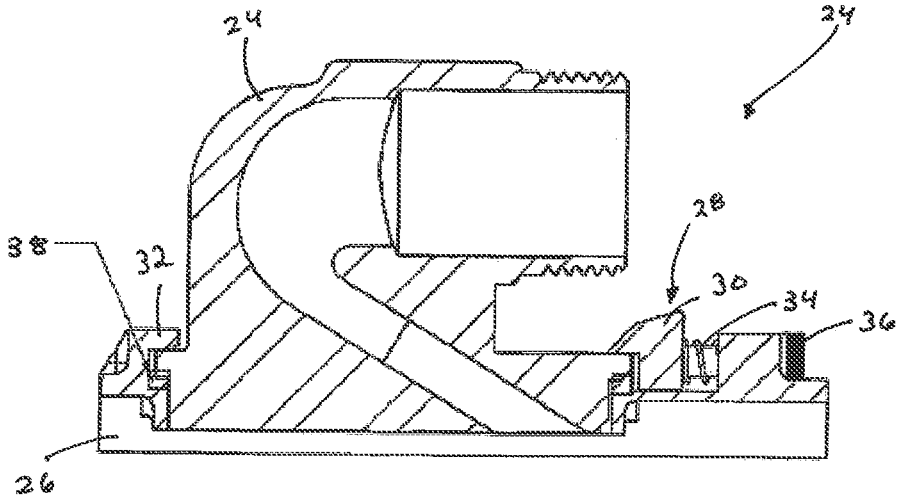
FIG. 4 is a cross-sectional view of the jet assembly of FIG. 2 along line B-B.

With reference to FIGS. 1-4, the toilet fixture 2 may also include a jet assembly 22 provided on an end of the jet pipe 14 and connected to the outlet pipe 8. The jet assembly 22 may be removably connected to the jet pipe 14 and the outlet pipe 8 so that the jet assembly 22 can be easily removed from the toilet fixture 2 to remove any debris that has built up within the jet assembly 22. The jet assembly 22 includes a jet 24, a mounting base 26, and a locking mechanism 28. The jet 24 defines a passageway to direct fluid from the inlet pipe 4 to the outlet pipe 8 and includes a first threaded end for connection to the jet pipe 14 and a flanged end for connection to the mounting base 26. The mounting base 26 may be welded or fastened to an outer surface of the outlet pipe 8. In another example, the mounting base 26 may be mechanically fastened according to any known technique for fastening two elements together, such as nuts and bolts, screws, clamps, and/or latches. The jet 24 may be held on the mounting base 26 using the locking mechanism 28. The locking mechanism 28 includes two locking arms 30, 32 that hold a bottom portion of the jet 24 between the mounting base 26 and the locking mechanism 28. One locking arm 30 may be slidable relative to the mounting base 26 and one locking arm 32 may be held stationary on the mounting base 26. The locking arm 30 may be spring-loaded into a lock position by a resilient member, such as a spring 34. An individual can move the locking arm 34 to an open position by pushing the locking arm 30 against the spring 34. As the locking arm 30 is moved away from the locking arm 34, an opening to receive the jet 24 is enlarged to permit an individual to remove or insert the jet 24. In the event the jet 24 is being inserted, upon release of the locking arm 30, the spring 34 biases the locking arm 30 back to the lock position to lock the jet 24 on the mounting base 26. Using this locking mechanism 28, an individual can easily and efficiently remove and attach the jet 24 to the mounting base 26 to keep the jet 24 free of debris. In one example of the present disclosure, the jet assembly 22 also includes at least one screw member 36 that can be used to adjust the biasing force of the spring 34 against the locking arm 30. The screw member 36 can also be removed to allow complete removal of the jet 24. As shown in FIG. 4, a sealing gasket 38 may be provided between the flanged end portion of the jet 24 and the mounting base 26 to ensure a leak-free connection between the jet 24 and the mounting base 26. The sealing gasket 38 may be made of an elastomer.

Figure 5:
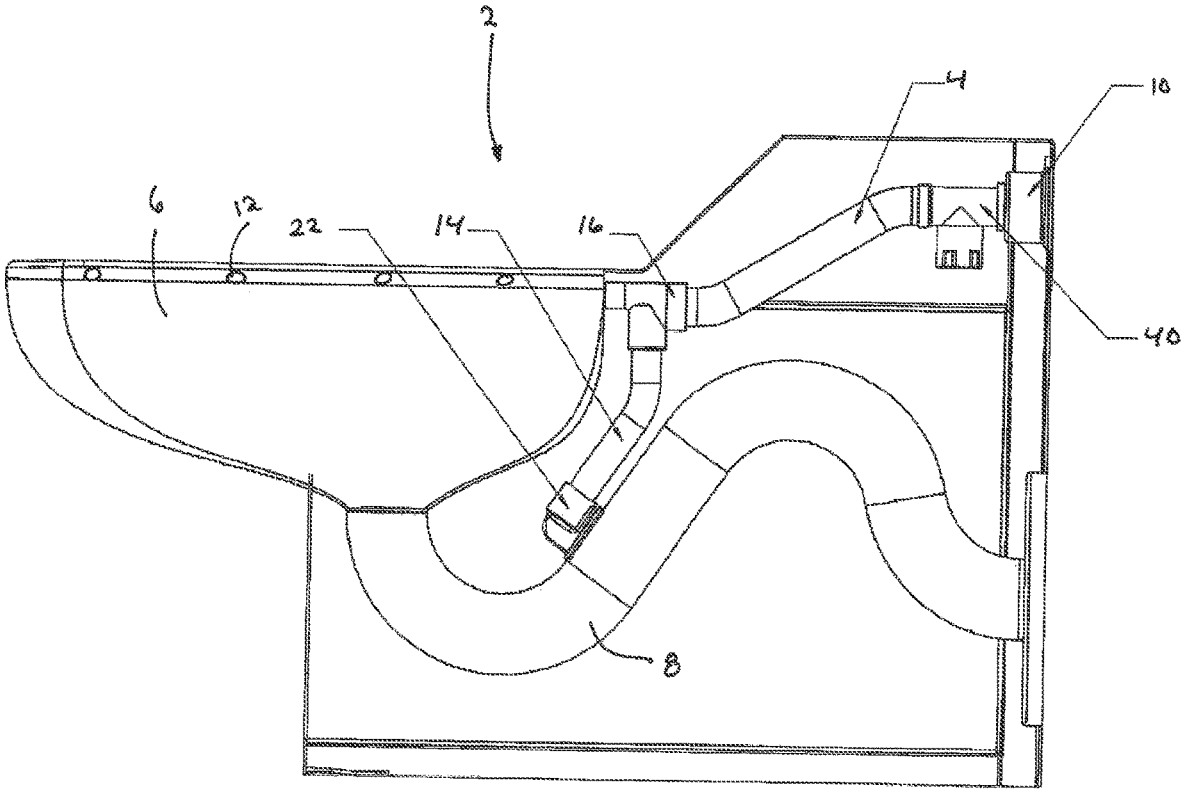
FIG. 5 is a side view of a toilet fixture according to another example of the present disclosure.
Figure 6:
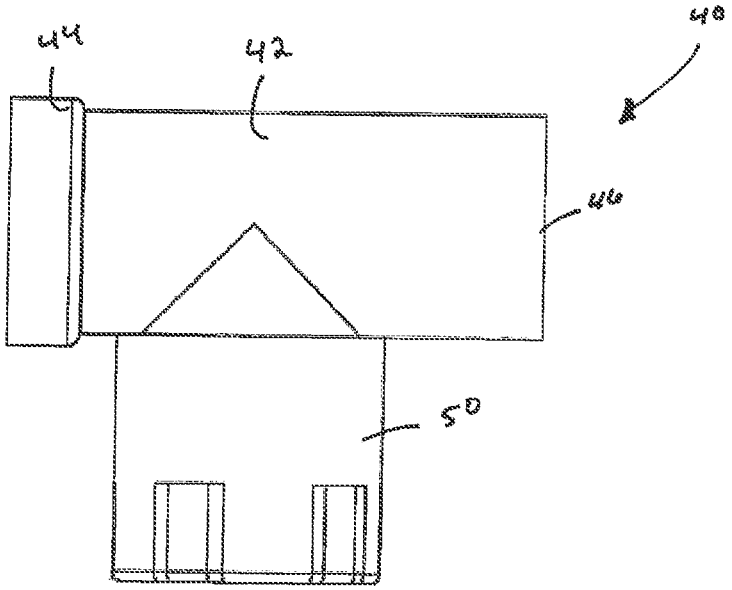
FIG. 6 is a side view of a foreign object strainer according to one example of the present disclosure.
Figure 7:
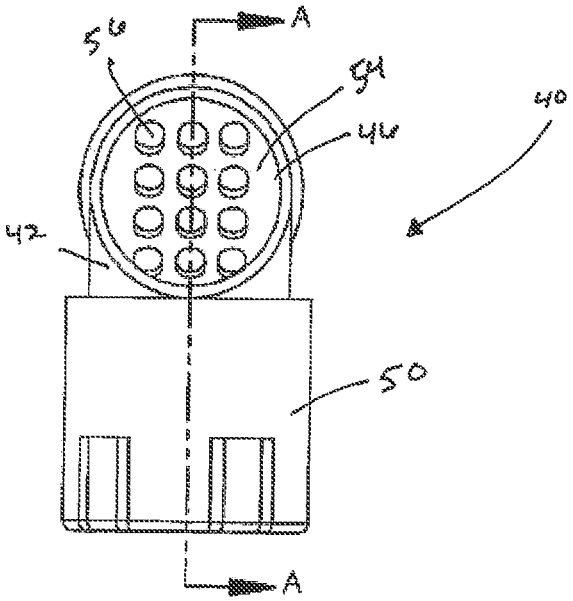
FIG. 7 is a front view of the foreign object strainer of FIG. 6.
Figure 8:
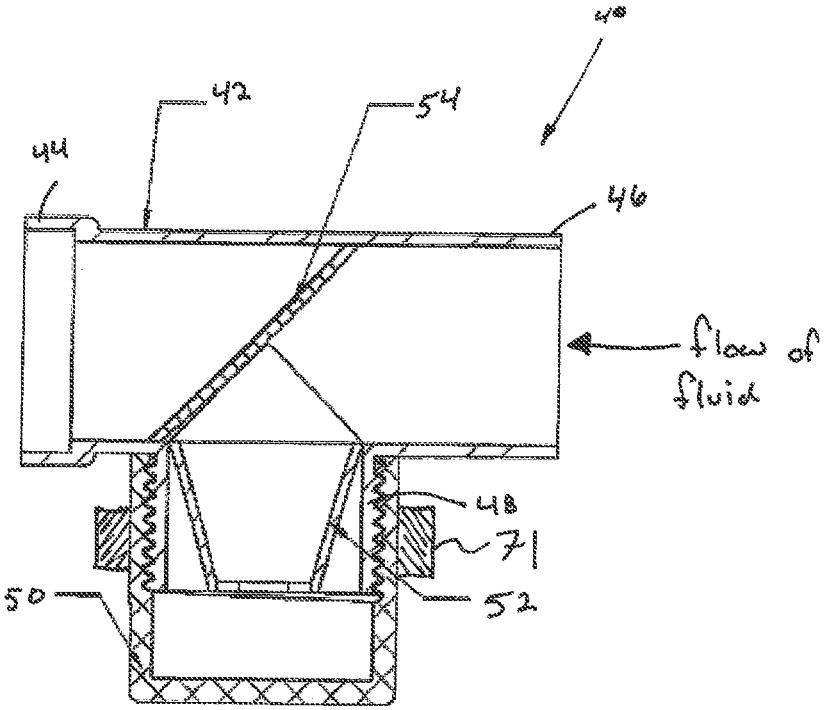
FIG. 8 is a cross-sectional view of the foreign object strainer of FIG. 6 along line A-A.

With reference to FIG. 5, in another example of the present disclosure, the toilet fixture 2 may include a foreign object strainer 40 to prevent foreign objects and debris from being directed into the inlet pipe 4, the toilet bowl 6, and/or the outlet pipe 8. The foreign object strainer 40 may be positioned in-line with the inlet pipe 4 upstream of the toilet bowl 6 to catch any foreign objects or debris that are directed into the inlet pipe 4 from the flush assembly. With reference to FIGS. 6-8, the foreign object strainer 40 includes a main body 42 having one end 44 for threaded attachment to the inlet pipe 4 and an opposing end 46 for connection to the fitting ring 10 of the toilet fixture 2. The main body 42 is substantially tubular and defines a passageway for fluid to flow from the flush assembly to the inlet pipe 4. The main body 42 also includes a threaded extension 48 that extends from a bottom surface of the main body 42. Removably attached to the threaded extension 48 is a cover 50 that can be threaded on and off the threaded extension 48. The threaded extension 48 defines a passageway that receives a foreign object reservoir 52. The foreign object reservoir 52 may be held in the threaded extension 48 by threading the cover 50 onto the threaded extension 48 to support the foreign object reservoir 52. The foreign object reservoir 52 is shaped as a receptacle to receive any debris and other foreign objects that are blocked by the foreign object strainer 40, as described in further detail below.

The foreign object strainer 40 also includes a foreign object strainer plate 54 that is positioned within the main passageway of the main body 42. The foreign object strainer plate 54 may be positioned at an angle within the main body 42 and relative to a longitudinal axis of the main passageway of the main body 42. The foreign object strainer plate 54 defines at least one aperture 56 to allow fluid to flow through the foreign object strainer plate 54. The apertures 56 are dimensioned so as to allow fluid to pass through the foreign object strainer plate 54 but prevent larger pieces of debris from passing through the foreign object strainer plate 54 and into the toilet fixture 2. It is contemplated that any number of apertures 56 may be defined in the foreign object strainer plate 54 and the apertures 56 may be dimensioned according to the needs of the specific toilet fixture 2 based on the size of the anticipated foreign objects moving through the toilet fixture 2. As shown in FIG. 8, in one example of the present disclosure, the top end of the foreign object strainer plate 54 is directed towards the end 46 of the main body 42 and the lower end of the foreign object strainer plate 54 is directed towards the end 44 of the main body 42. Therefore, as fluid and debris from the flush assembly as directed into the foreign object strainer 40, the debris is blocked by the foreign object strainer plate 54 and the fluid is permitted to flow through the apertures 56 of the foreign object strainer plate 54 and into the inlet pipe 4. The debris blocked by the foreign object strainer plate 54 falls into the foreign object reservoir 52. Periodically, an individual can remove the cover 50 from the threaded extension 48 to remove the foreign object reservoir 52 and empty the debris from the foreign object reservoir 52. The foreign object reservoir 52 can then be inserted back into the foreign object strainer 40 and the cover 50 can be threaded back onto the threaded extension 48. Using the foreign object strainer 40, debris and other unwanted objects from the flush assembly can be blocked from entering the inlet pipe 4 and the remaining components of the toilet fixture 2.

Figure 9:
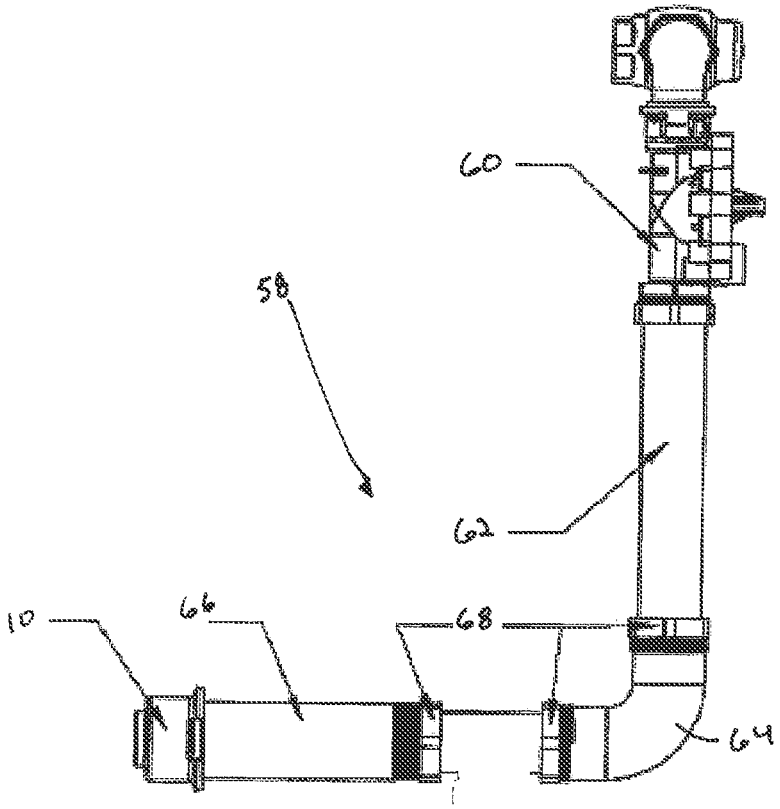
FIG. 9 is a toilet fixture according to another example of the present disclosure.
Figure 10:
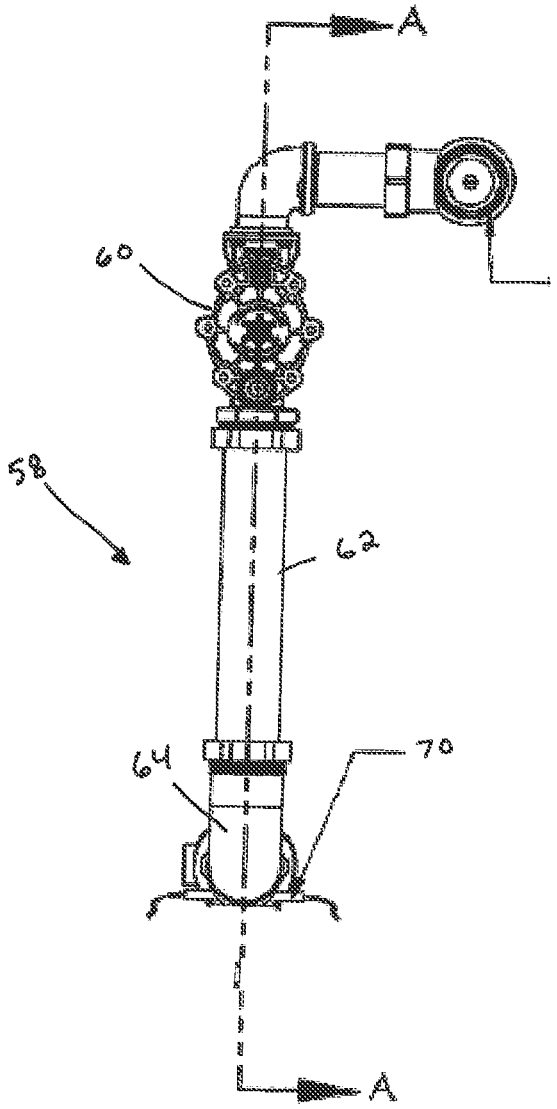
FIG. 10 is a front view of the toilet fixture of FIG. 9.
Figure 11:
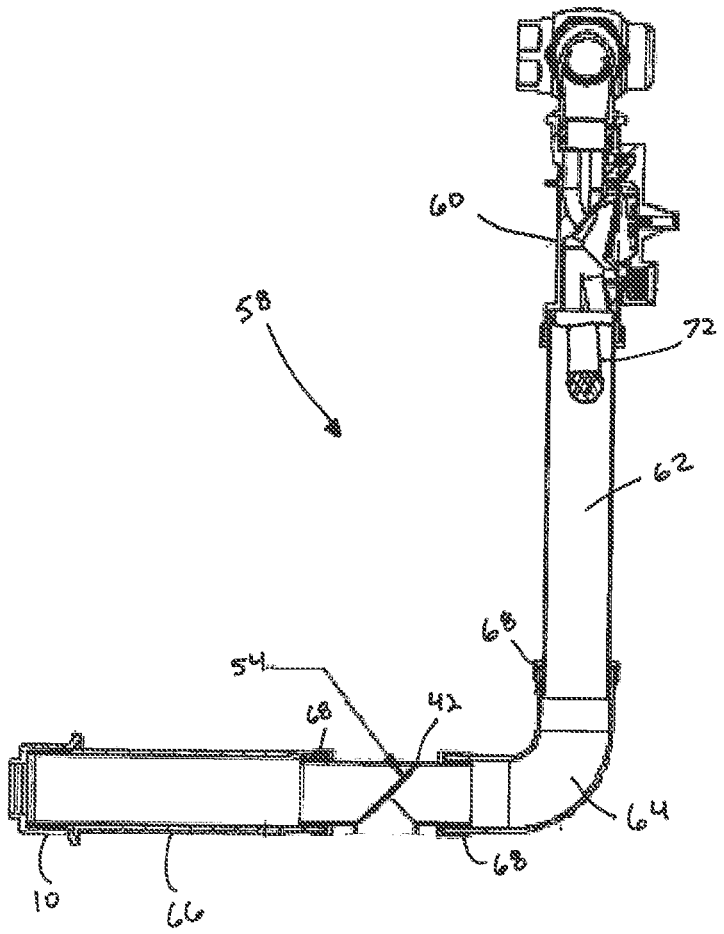
FIG. 11 is a cross-sectional view of the toilet fixture of FIG. 9 along line A-A.

With reference to FIGS. 9-11, the foreign object strainer 40 described above is shown in use with a flush assembly 58 according to one example of the present disclosure. The flush assembly 58 includes a momentum flush valve 60 to direct fluid through the flush assembly 58 and into the toilet fixture 2, a vacuum breaker pipe 62, an elbow joint 64 that connects the vacuum breaker pipe 62 to the foreign object strainer 40, and an outlet pipe 66 connected at one end to the foreign object strainer 40 and at an opposing end to the inlet pipe 4 of the toilet fixture 2. The elbow joint 64 is connected to the vacuum breaker pipe 62 and the foreign object strainer 40 via slip joint nuts 68. The foreign object strainer 40 is connected to the outlet pipe 66 via a slip joint nut 68.

The foreign object strainer 40 used with the flush assembly 58 is substantially similar to the foreign object strainer 40 described above in connection with the toilet fixture 2. The foreign object strainer 40 includes a foreign object strainer plate 54 that is angled towards the elbow joint 64 so that, as the foreign object strainer 40 blocks debris in the fluid passing through the fluid object strainer 40, the debris is directed down into the foreign object reservoir 52. The foreign object reservoir 52 is held in the foreign object strainer 40 by the cover 50. When provided in the flush assembly 58, the foreign object strainer 40 may also include a reservoir overflow detection aperture 70. The reservoir overflow detection aperture 70 is an aperture defined in the foreign object strainer 40 that permits an individual to determine when the foreign object reservoir 52 is full or if large pieces of debris have been lodged in the foreign object strainer 40. In another example of the present disclosure, the reservoir overflow detection aperture 70 may include a sensor 71 that notifies an individual when the foreign object reservoir 52 is full or if large pieces of debris have been lodged in the foreign object strainer 40. In one example of the present disclosure, the sensor 71 may be a through-beam sensor that detects when debris has been lodged in the foreign object strainer 40. The through-beam sensor may shoot a laser beam through the foreign object strainer 40 and when the debris passes through the laser beam the sensor 71 will identify this debris and send an appropriate signal to a controller to notify a user. In another example of the present disclosure, a pressure detector sensor may be provided on the main body 42 adjacent the opposing end 46. In the event a high pressure is created in the main body 42 due to debris blockage, the pressure detector sensor will identify this high pressure and send an appropriate signal to a controller to notify a user. In another example of the present disclosure, the cover 50 may be made of a clear/transparent material that would allow a user to look into the cover 50 to identify whether debris has been lodged in the foreign object strainer 40. In another example of the present disclosure, the sensor 71 may be a reflective sensor that would detect debris in the foreign object strainer 40 similar to an infrared sensor.

Figure 12:
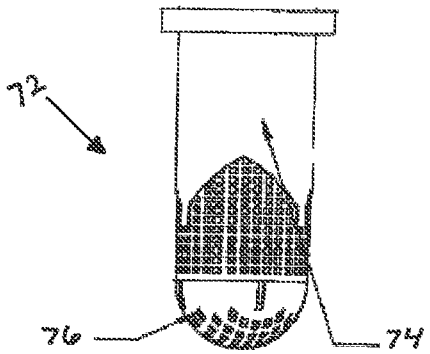
FIG. 12 is a side view of a strainer according to one example of the present disclosure.
Figure 13:
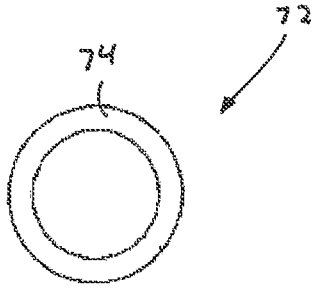
FIG. 13 is a top view of the strainer of FIG. 12.
Figure 14:
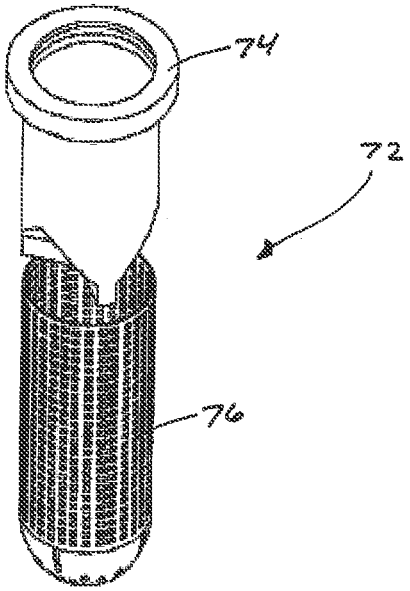
FIG. 14 is an exploded perspective view of the strainer of FIG. 12.

With reference to FIGS. 12-14, a vacuum breaker and foreign object strainer assembly 72 (referred to hereinafter as "assembly 72") is shown and described. The assembly 72 includes a vacuum breaker 74 and an integral mesh strainer 76. As shown in FIG. 12, in one example of the present disclosure, the assembly 72 may be formed as a monolithic structure. As shown in FIG. 14, in one example of the present disclosure, the assembly 72 may be provided as separate components operatively connected to one another. The vacuum breaker 74 may be made of an ethylene propylene diene monomer (EPDM) rubber. The mesh strainer 76 may be made of stainless steel. The vacuum breaker 74 may be formed integral with the mesh strainer 76. The assembly 72 may be included in the flush assembly 58 to prevent backflow of fluid from the toilet fixture 2 into the flush assembly 58. As shown in FIG. 11, the assembly 72 may be positioned in vacuum breaker pipe 62 beneath the momentum flush valve 60. In one example, the assembly 72 may be molded with the vacuum breaker pipe 62. In another example, the assembly 72 is removably inserted in the vacuum breaker pipe 62. The mesh strainer 76 defines a plurality of apertures that allow fluid to pass therethrough but block any debris from moving past the vacuum breaker 74 and into the flush assembly 58 or toilet fixture 2. The apertures are dimensioned so as to allow fluid to pass through the mesh strainer 76 but prevent larger pieces of debris from passing through the mesh strainer 76 and into the flush assembly 58 or the toilet fixture 2. Once debris has built up in the mesh strainer 76, the assembly 72 can be removed to clear the debris from the mesh strainer 76.

While several aspects of the toilet fixture and flush assembly are shown in the accompanying figures and described in detail hereinabove, other aspects will be apparent to, and readily made by, those skilled in the art without departing from the scope and spirit of the disclosure.

Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. A toilet fixture, comprising:

an inlet pipe;

a toilet bowl in fluid communication with the inlet pipe;

an outlet pipe in fluid communication with the toilet bowl;

a jet pipe in fluid communication with the inlet pipe and the outlet pipe; and a foreign object strainer connected to the inlet pipe, wherein the foreign object strainer comprises:

a main body connected to the inlet pipe;

a foreign object strainer plate positioned within the main body and in-line with the inlet pipe; and a foreign object reservoir positioned beneath the foreign object strainer plate and offset from the inlet pipe, wherein a removable cover supports the foreign object reservoir in the foreign object strainer and is configured to permit the foreign object reservoir to be removed from the foreign object strainer to empty debris from the foreign object reservoir.

2. The toilet fixture as claimed in claim 1, wherein the removable cover is threadedly attached to the main body.

3. The toilet fixture as claimed in claim 1, wherein the foreign object strainer plate is positioned at an angle relative to a longitudinal axis of a main passageway of the main body.

4. The toilet fixture as claimed in claim 1, wherein the foreign object strainer plate defines at least one aperture.

5. The toilet fixture as claimed in claim 4, wherein the at least one aperture is sized to permit fluid to pass therethrough and block debris in the fluid from passing therethrough.

* * * * *